US011737947B2

(12) United States Patent
Alsaedi et al.

(10) Patent No.: US 11,737,947 B2
(45) Date of Patent: Aug. 29, 2023

(54) HANDHELD ELECTRO-MECHANICAL WALKING AID

(71) Applicants: Muath Qasem Alsaedi, Almaddinah-Almunawwarah (SA); Virang Akhiyaniya, Ahmedabad (IN)

(72) Inventors: Muath Qasem Alsaedi, Almaddinah-Almunawwarah (SA); Virang Akhiyaniya, Ahmedabad (IN)

(73) Assignee: Muath Qasem Alsaedi

( * ) Notice: Subject to any disclaimer, the term of this patent is extended or adjusted under 35 U.S.C. 154(b) by 0 days.

(21) Appl. No.: 17/639,418

(22) PCT Filed: Oct. 9, 2021

(86) PCT No.: PCT/IB2021/059265
§ 371 (c)(1),
(2) Date: Mar. 1, 2022

(87) PCT Pub. No.: WO2022/074629
PCT Pub. Date: Apr. 14, 2022

(65) Prior Publication Data

US 2022/0401289 A1 Dec. 22, 2022

Related U.S. Application Data

(60) Provisional application No. 63/090,173, filed on Oct. 9, 2020.

(51) Int. Cl.
*A61H 3/06* (2006.01)

(52) U.S. Cl.
CPC ..... *A61H 3/061* (2013.01); *A61H 2201/1207* (2013.01); *A61H 2201/1635* (2013.01); *A61H 2201/1671* (2013.01); *A61H 2201/5058* (2013.01); *A61H 2201/5092* (2013.01); *A61H 2201/5097* (2013.01)

(58) Field of Classification Search
CPC combination set(s) only.
See application file for complete search history.

(56) References Cited

U.S. PATENT DOCUMENTS

| | | | |
|---|---|---|---|
| 7,524,297 | B2 | 4/2009 | Shimada et al. |
| 2009/0048686 | A1 | 2/2009 | Ikeuchi et al. |
| 2011/0205067 | A1 | 8/2011 | Konishi et al. |
| 2013/0041507 | A1 | 2/2013 | Ota et al. |
| 2015/0359699 | A1 | 12/2015 | Chang et al. |

*Primary Examiner* — Thomas S McCormack
(74) *Attorney, Agent, or Firm* — Mark C. Johnson; Johnson Dalal

(57) ABSTRACT

A handheld electro-mechanical walking aid operably configured to detect objects or obstacles in an ambient environment and guide the user away from the detected obstacles and comprising a handle member for grasping, an electronic motor assembly, a cantilevered guide arm member operably coupled to at least one electronic motor and having an arm weight and a concentrated weight of at least approximately 0.2 lbs, at least one of a distance sensor and a camera operably configured to detect objects spatially displaced from a second free end of the arm member, and an electronic controller operably configured to receive detection of the objects spatially displaced from the second free end and cause selective rotation of the arm member in a direction away from the detected objects to generate a deviation angle θ, thereby causing an impetus to the user holding the handle member through a torque generated by the arm weight.

14 Claims, 20 Drawing Sheets

HANDHELD ELECTRO-MECHANICAL WALKING AID

FIELD OF THE INVENTION

The present invention relates generally to walking aids, and, more particularly, relates to electro-mechanical walking aids operably configured to aid users in walking or otherwise moving around in an ambient environment (which is particularly beneficial for visually impaired or disabled users).

BACKGROUND OF THE INVENTION

Navigating an ambient environment, i.e., one's immediate surroundings, is significantly more arduous and time-consuming where one is unfamiliar with the ambient environment and/or, for health, medical, environmental, or other reasons, is unable to effectively, accurately, or timely perceive significant objects or obstacles that may block or obstruct one's path. Particularly with respect to visually impaired or disabled users, readily perceiving and detecting such obstacles, and then adjusting one's path accordingly, may not be as simple without the assistance of a walking aid. Existing walking aids, however, generally require a user to continuously pan the walking aid or stick from side-to-side in order to detect objects that are approximately 3 feet to 5 feet in front of the user. These walking aids are characterized by significant limitations including limited means of detection, i.e., such aids generally only detect objects directly in front of the user and not necessarily to the side of, above, or behind the user, and the difficulty and inconvenience of use, i.e., a user must continuously pan the walking stick from side-to-side to avoid obstacles, resulting in accelerated arm fatigue. Detection of an object only occurs when the walking stick comes into direct physical contact with the foreign object which, particularly in cases where the object is another person, pet, or animal, may result in a painful or offensive touching to the detected object (such as when the user is panning the walking stick with a higher speed).

Therefore, a need exists to overcome the problems with the prior art as discussed above.

SUMMARY OF THE INVENTION

The invention provides a handheld electro-mechanical walking aid primarily designed for the vision impaired and that overcomes the hereinafore-mentioned disadvantages of the heretofore-known devices and methods of this general type and that effectively and efficiently alerts a user to objects and obstacles in the user's ambient environment and beneficially guides the user along a path away from the detected objects or obstacles.

With the foregoing and other objects in view, there is provided, in accordance with the invention, a handheld electro-mechanical walking aid comprising a handle member for grasping by a user and having a first end, a second end, a handle member length separating the first and second ends of the handle member, a front handle surface, and a rear handle surface opposing the front handle surface; an electronic motor assembly with at least one electronic motor electrically coupled to a battery power source; a cantilevered guide arm member operably coupled to the at least one electronic motor, with a first end rotatably coupled to the handle member, a second free end opposing the first end of the cantilevered guide arm member, an arm length separating the first end and second free end of the cantilevered guide arm member, an arm weight disposed proximal to the second free end and of a concentrated weight of at least approximately 0.2 lbs, and operably configured to translate along an arm translation path and have an operation position along the arm translation path with a longitudinal axis of the cantilevered guide arm member disposed at a substantially perpendicular angle with respect to the front handle surface and aligned with the front handle surface; at least one of a distance sensor and a camera each having an operation surface operably configured to face in alignment configuration with the longitudinal axis of the cantilevered guide arm member when in the operation position and operably configured to detect objects spatially displaced from the second free end therefrom; and an electronic controller electrically coupled to the battery power source and communicatively coupled to the at least one electronic motor and the at least one of a distance sensor and a camera, the electronic controller operably configured to receive detection of the objects spatially displaced from the second free end and cause selective rotation of the cantilevered guide arm member in a direction away from the detected objects to generate a deviation angle θ with respect to the operation position along the arm translation path, thereby causing an impetus to the user holding the handle member through a torque generated by the arm weight and guiding the user where to walk.

In accordance with another feature, the operation position includes the cantilevered guide arm member disposed at a perpendicular angle with respect to the front handle surface.

In accordance with a further feature of the present invention, an embodiment of the present invention includes an arm head housing disposed along the arm length and with the arm weight and the at least one of a distance sensor and a camera housed therein.

In accordance with yet another feature, the head housing defines the second free end of the cantilevered guide arm member.

In accordance with a further feature, the arm head housing further comprises a laser-guided distance sensor and a ultrasound distance sensor communicatively coupled to the electronic controller and operably configured to detect objects spatially displaced from the second free end therefrom.

In accordance with another feature of a preferred embodiment, the present invention also includes a gyroscope housed within the handle member, communicatively coupled to the electronic controller, and operably configured to detect a cardinal direction orientation of the front handle surface, the electronic controller operably configured to cause selective rotation of the cantilevered guide arm member to the operation position aligned with the cardinal direction orientation of the front handle surface after detecting the deviation angle θ.

In accordance with yet another feature, the handheld electro-mechanical walking aid also includes a memory storage unit housed on the handheld electro-mechanical walking aid and storing a plurality of digital geographic locations each having a plurality of GPS boundary coordinates; and at least one button operably configured to electronically access the plurality of GPS boundary coordinates for the plurality of digital geographic locations.

In accordance with a further feature, the electronic controller is operably configured to cause selective rotation of the cantilevered guide arm member to a desired deviation angle θ corresponding to one of the plurality of digital geographic locations and a cardinal direction orientation of the front handle surface.

In accordance with another feature, the cantilevered guide arm member is operably configured to rotate in an upward orientation when the cantilevered guide arm member is within 50 meters of a preselected digital geographic location.

In accordance with yet another feature, the plurality of digital geographic locations are communicatively coupled to the electronic controller over a network.

In accordance with a further feature of the present invention, the at least one of a distance sensor and a camera are each operably configured to detect objects spatially displaced six feet or less from the second free end therefrom.

In accordance with yet another feature, the cantilevered guide arm member must be oriented in the operation position to selectively rotate or translate along the arm translation path.

In accordance with another feature, the electronic motor assembly further comprises a pan motor operably configured to pan the camera horizontally from a fixed position; and a tilt motor operably configured to tilt the camera vertically from a fixed position.

In accordance with a further feature, the cantilevered guide arm member also includes a plurality of arm members telescopically coupled to one another and operably configured to selectively adjust the arm length.

Although the invention is illustrated and described herein as embodied in a handheld electro-mechanical walking aid, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the handheld electro-mechanical walking aid. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

The invention described herein provides a handheld electro-mechanical walking stick that overcomes known disadvantages of those known devices and methods of this general type and that effectively, efficiently, and safely facilitates providing visual, audio, and (importantly) physical cues or sensations perceivable by a user holding the walking stick. Although the invention is illustrated and described herein as embodied in a handheld electro-mechanical walking stick, it is, nevertheless, not intended to be limited to the details shown because various modifications and structural changes may be made therein without departing from the spirit of the invention.

The present invention provides a novel and efficient device and method operably configured to detect objects and obstacles in a user's ambient environment that may obstruct a user's path when walking, e.g., directly in front of, to the side of, above, or perhaps even behind a user, and alert the user of the detected objects' presence and location by generating a torque that manifests in a readily perceptible or detectable tactile sensation on the user's wrist or forearm. Embodiments of the invention provide a cantilevered guide arm member with an arm weight disposed proximal to the second free end thereof, wherein the length of the cantilevered guide arm member and the weight of the arm weight aid in generating a greater torque and beneficially guiding the user away from the detected objects or obstacles. Specifically, the cantilevered guide arm member is operably configured to selectively rotate away from the detected objects or obstacles, effectively steering the user away from said objects and enabling the user to smoothly continue on the user's path. In alternate embodiments, the device may also be operable to emit an audio or visual cue to the user as to where the user should walk to avoid the detected objects.

Figure 1:
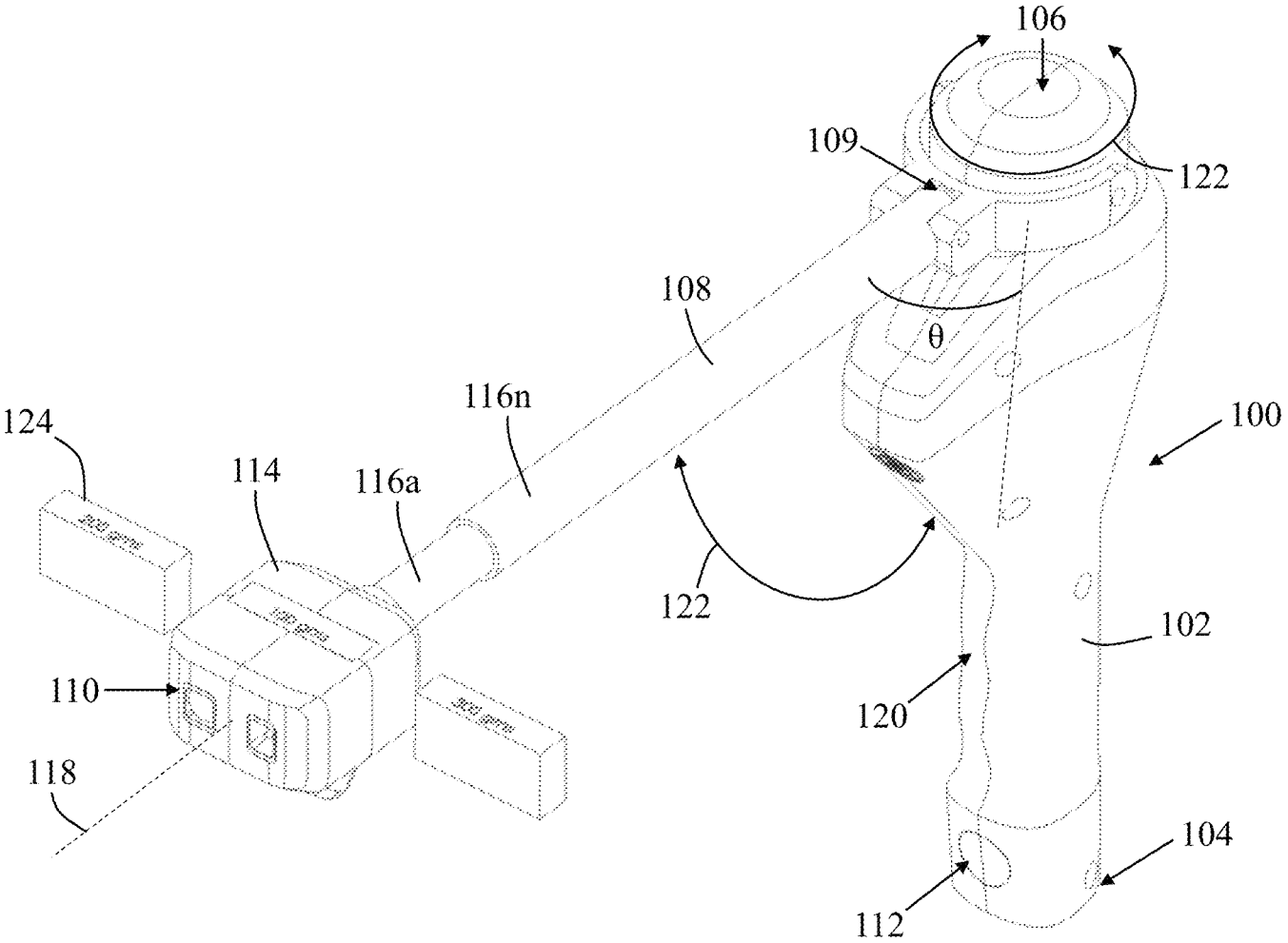
FIG. 1 is a perspective top view of a handheld electro-mechanical walking stick, in accordance with an exemplary embodiment of the present invention.

Referring now to FIG. 1, one embodiment of the present invention is shown in a perspective view. FIG. 1 (along with the other figures herein) shows several advantageous features of the present invention, but, as will be described below, the invention can be provided in several shapes, sizes, combinations of features and components, and varying numbers and functions of the components. The first example of a handheld electro-mechanical walking stick 100 (referred to hereinafter as "device 100" for ease of reference), as shown best in FIG. 1 and FIG. 2, includes a handle member 102 for grasping by a user and having a first end 104, a second end 106, a handle member length separating the first and second ends 104, 106 of the handle member 102, a front handle surface 120, and a rear handle surface 208 opposing the front handle surface 120. The handle member 102 may be of a substantially rigid, yet lightweight, material (e.g., PVC or polypropylene) for increased user comfort during repeated, continuous, and/or frequent use. The handle member 102 may also have a padded or deformably resilient material disposed thereon for added user comfort and may beneficially include a loop or strap disposed at or proximal to the first end 104 (wherein "proximal to" is defined as at or near, i.e., a distance of no more than 40% of the handle member length), whereby the loop or strap may include a charging port for charging a battery power source 200 (e.g., a lithium-ion battery) located on the device 100. Beneficially, the front handle surface 120 may include a plurality of ridges, indentations, or other defined undulating surfaces for receiving a user's fingers. Said differently, the user's palm would be placed on the rear handle surface 208 and the user's fingers would wrap around the front handle surface 120. The plurality of ridges, indentations, or other defined undulating surfaces beneficially improve the user's sustained grip around the handle member 102. The handle member 102 may consist of two or more shell members that are selectively couplable together to define a handle cavity shaped and sized to receive and house the electrical and mechanical components discussed and depicted herein.

Figure 2:
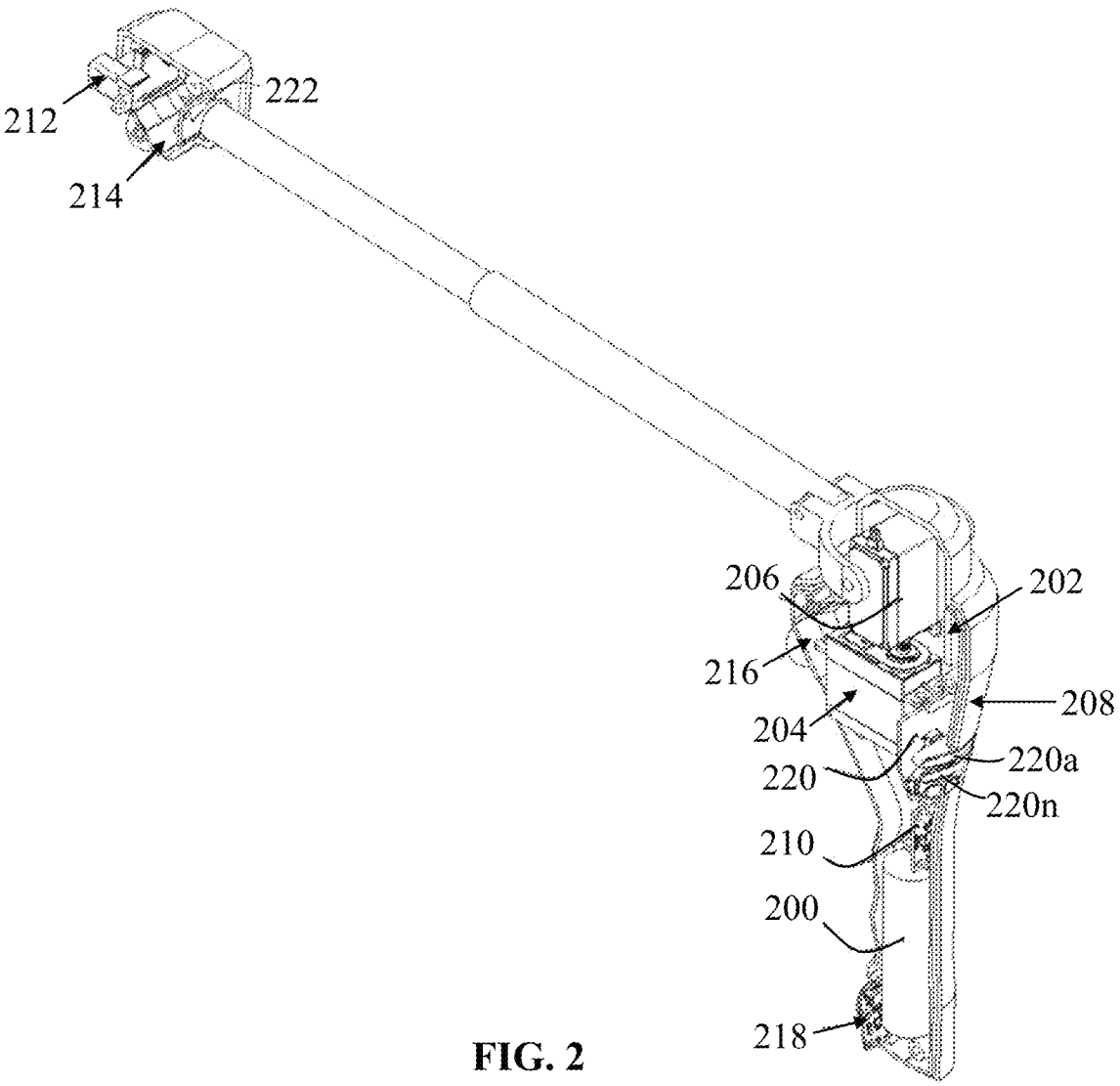
FIG. 2 is a cross-sectional side view of the exemplary handheld electro-mechanical walking stick of FIG. 1, in accordance with the present invention.

As best seen in FIG. 2, the device also includes an electronic motor assembly 202 with at least one electronic motor 204 electrically coupled to the battery power source 200. In one embodiment, the motor assembly 202 includes two motors operably coupled to a gear assembly configured to provide selective motor-based (e.g., servo-controlled) rotation of a cantilevered guide arm member 108 in both the x-axis or y-axis relative to the user holding the device 100, namely the handle member 102, in an upright orientation with respect to the ground surface. In other embodiments, a motor may be utilized to control rotation or movement in the z-axis and/or have omni-directional rotation or movement. Said differently, the motor(s) are operably configured to cause rotation of the cantilevered guide arm member 108 up-and-down with respect to the user holding the device 100 or side-to-side with respect to the user holding the device 100. The handle member 102, however, will remain relatively stationary, thereby causing an impetus or force physically felt by the user, serving as a cue for the direction in which the user is to walk (thereby avoiding the object detected by the device—as discussed further herein). In other embodiments of the present invention, a single motor is configured to provide selective rotation of the cantilevered guide arm member 108, multiple motors may be independently utilized for individual rotation in any desired axis, and/or the cantilevered guide arm member 108 is operably configured to move in other axes (e.g., a diagonal z-axis) relative to the user holding the device 100. For simplicity in construction, the cantilevered guide arm member 108 may only be rotated in two axes (as depicted best in FIG. 1) and may rotate approximately 180°-360° in the x-axis or horizontally and may rotate approximately 90°-270° in the y-axis or vertically. The device 100 may beneficially come with a charging station or wall mount configured to plug or otherwise electrically couple with an electrical outlet. The charging station may include an electrical port adapted to mate with the charging port located on the loop or strap of the device.

The cantilevered guide arm member 108 is operably coupled to the one or more electronic motor(s), e.g., motor 204, with a first end 109 rotatably coupled to the handle member 102 (using, for example, a ball joint or bracket), a second free end 110 opposing the first end 109 of the cantilevered guide arm member 108, and an arm length separating the first end and second free end 110 of the cantilevered guide arm member 108. The cantilevered guide arm member 108, like the handle member 102, may also be of a substantially rigid, yet lightweight, material for ease and comfort of prolonged or repeated use. The cantilevered guide arm member 108 further includes an arm weight 124 disposed proximal to the second free end 110, i.e., at or near (within 30% of the overall length of the cantilevered guide arm member 108) the second free end 110, and of a concentrated weight of at least approximately 0.2 lbs, wherein "concentrated weight" is defined as a weight distribution less than 50% of the longitudinal length of the cantilevered guide arm member 108. Said differently, the concentrated weight and arm weight 124 may be independent and selectively removable with respect to the cantilevered guide arm member 108. To increase or improve the user's tactile perception and detection of the movement of the cantilevered guide arm member 108, the arm weight 124 should preferably be disposed proximal to the second free end 110 rather than spread out over the arm length. One example of a concentrated weight may include a weighted object or structure disposed proximal to the second free end 110, wherein the surrounding weight of the structure adjacent thereto or along the length of the cantilevered guide arm member 108 does not exceed said weighted object or structure.

The cantilevered guide arm member 108 is operably configured to translate along an arm translation path (e.g., one or both of the paths represented with arrows 122) and have an operation position (also referred to as the "home" position) along the arm translation path with a longitudinal axis 118 of the cantilevered guide arm member 108 disposed at a substantially perpendicular angle with respect to the front handle surface 120 and aligned with the front handle surface 120.

Figure 11:
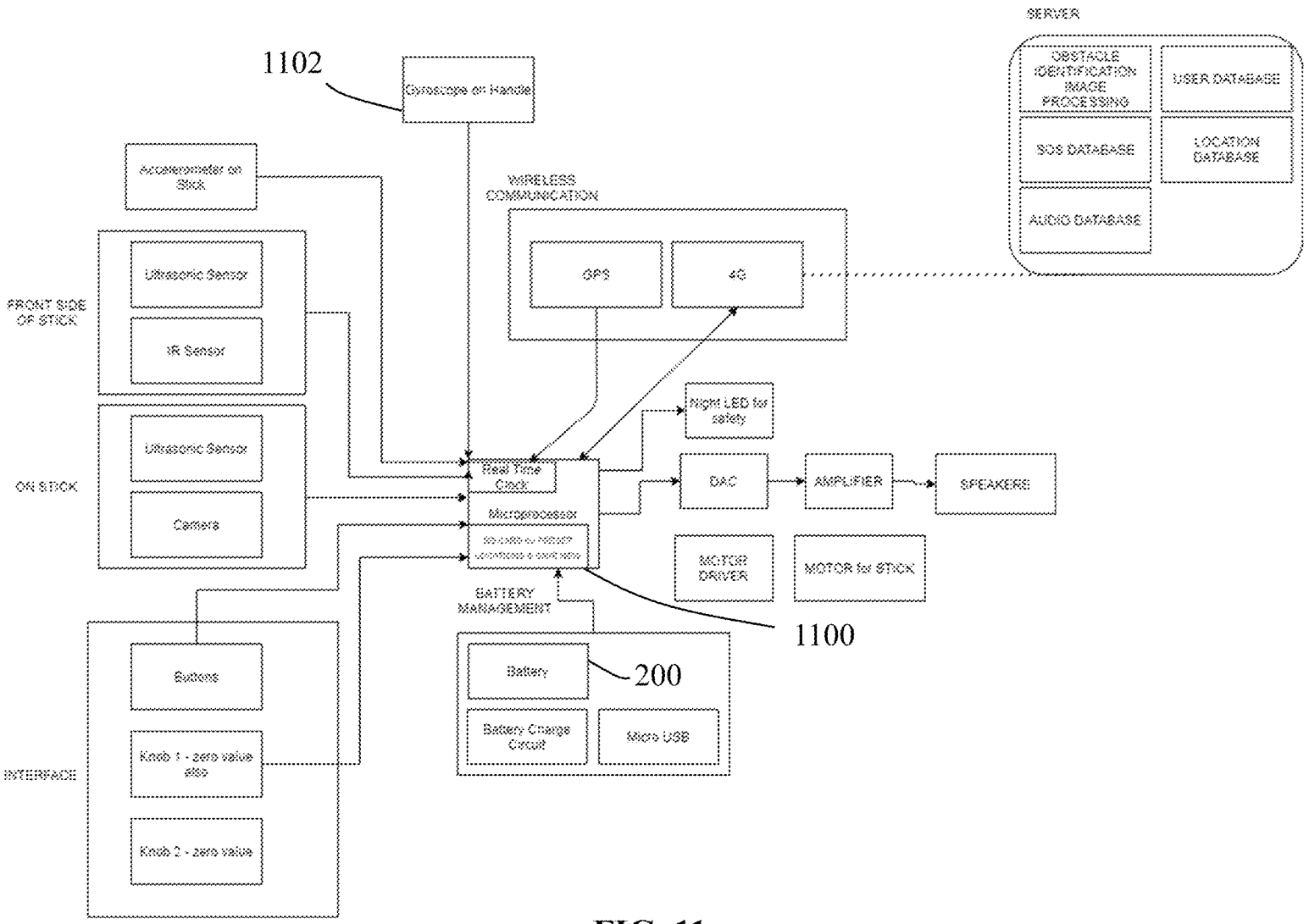
FIG. 11 is a block diagram of the wireless communication of an exemplary handheld electro-mechanical walking stick, in accordance with the present invention.

The device 100 further includes at least one of a distance sensor 216 and a camera 112 (i.e., a distance sensor 216, a camera 112, or both) each having an operation surface operably configured to face in alignment configuration, i.e., partially or completely aligned, with the longitudinal axis 118 of the cantilevered guide arm member 108 when in the operation position and operably configured to detect objects spatially displaced from the second free end 110 therefrom. The operation surface may be a camera lens or a screen in various embodiments. One or more camera(s) 112 may be disposed proximal to the second free end 110 (or other location along the length of the cantilevered guide arm member 108), i.e., at or near (within 20-40% of the overall length of the cantilevered guide arm member 108 of) the second free end 110. In alternate embodiments, one of more camera(s) 112 may be disposed on the handle member 102 itself, in addition to or in place of the camera(s) 112 disposed on the cantilevered guide arm member 108. The camera(s) 112 is operably configured to capture images (video or still pictures) within 2-6 feet away from the second free end 110. In one embodiment, a single camera is utilized and may be operably configured to receive and detect objects within at least a 180° range of vision, wherein in other embodiments, a plurality of cameras 112 are utilized and disposed in locations on a second free end 110 of the cantilevered guide arm member 108 such that the cameras 112 are oriented to face away from each opposing side of the camera mount and away from the front of the camera mount, thereby enabling detection of objects in various positions relative to the second free end of the cantilevered guide arm member 108. The cantilevered guide arm member 108 is operably coupled to the electronic motor assembly 202, thereby enabling rotation along the vertical or horizontal axes. While the device 100 is beneficially operable to cause the user to experience the impetus, i.e., the force that manifests in a readily perceptible or detectable tactile sensation, caused by the rotation of the cantilevered guide arm member 108 away from the object detected in the user's ambient environment (e.g., 2 ft-10 ft), the device 100 may also be operable to emit an audio (e.g., using a speaker) or visual (e.g., using a light-emitting source) cue to the user as to where the user should walk to avoid the detected object. As such, the distance sensor 216 may be a laser-based, ultrasound, infrared, or other comparable distance sensor operably configured to alert a user. In one embodiment, a laser-guided distance sensor 212 and a ultrasound distance sensor 214 (as depicted in FIG. 11) are communicatively coupled to the electronic controller 210 and operably configured to detect objects spatially displaced from the second free end 110 therefrom. In conjunction, use of both the laser-guided distance sensor 212 and the ultrasound distance sensor 214 is operably configured to increase the accuracy and speed with which an object is detected. A camera sensor 218 (as seen in FIG. 2) or distance sensor may also be disposed on the front handle surface 120. The sensors 212, 214 may be electrically and communicatively coupled to a head PCB board 222.

Figure 4:
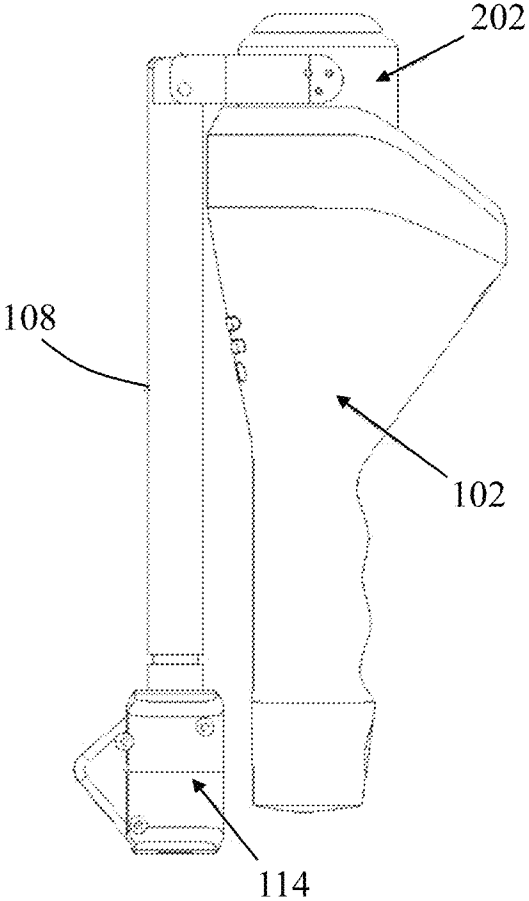
FIG. 4 is an elevational side view of the handheld electro-mechanical walking stick of FIG. 1, in accordance with an exemplary embodiment of the present invention.
Figure 5:
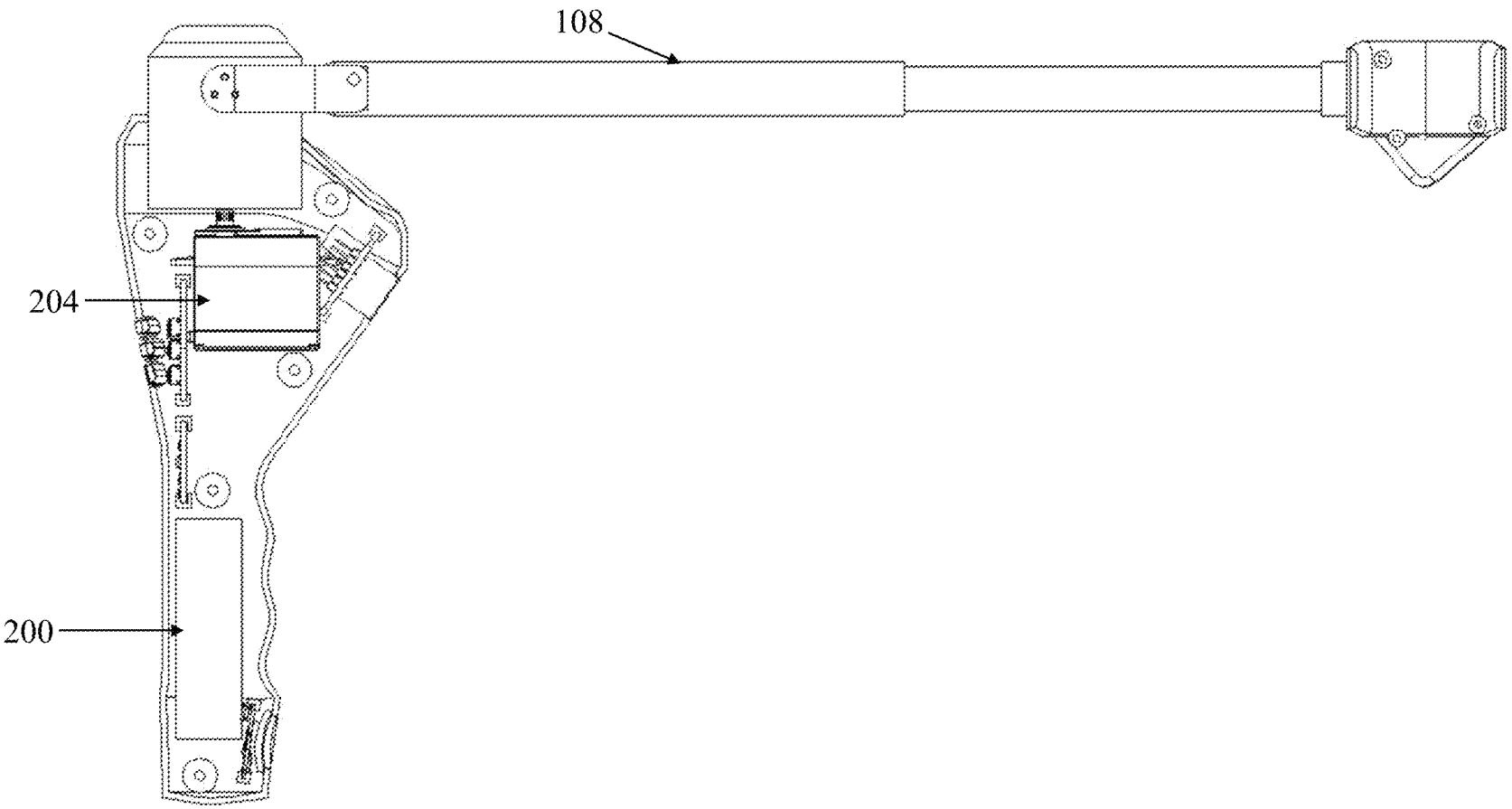
FIGS. 5-7 depict elevational and cross-sectional side views of the handheld electro-mechanical walking stick of FIG. 1, in accordance with an exemplary embodiment of the present invention.
Figure 6:
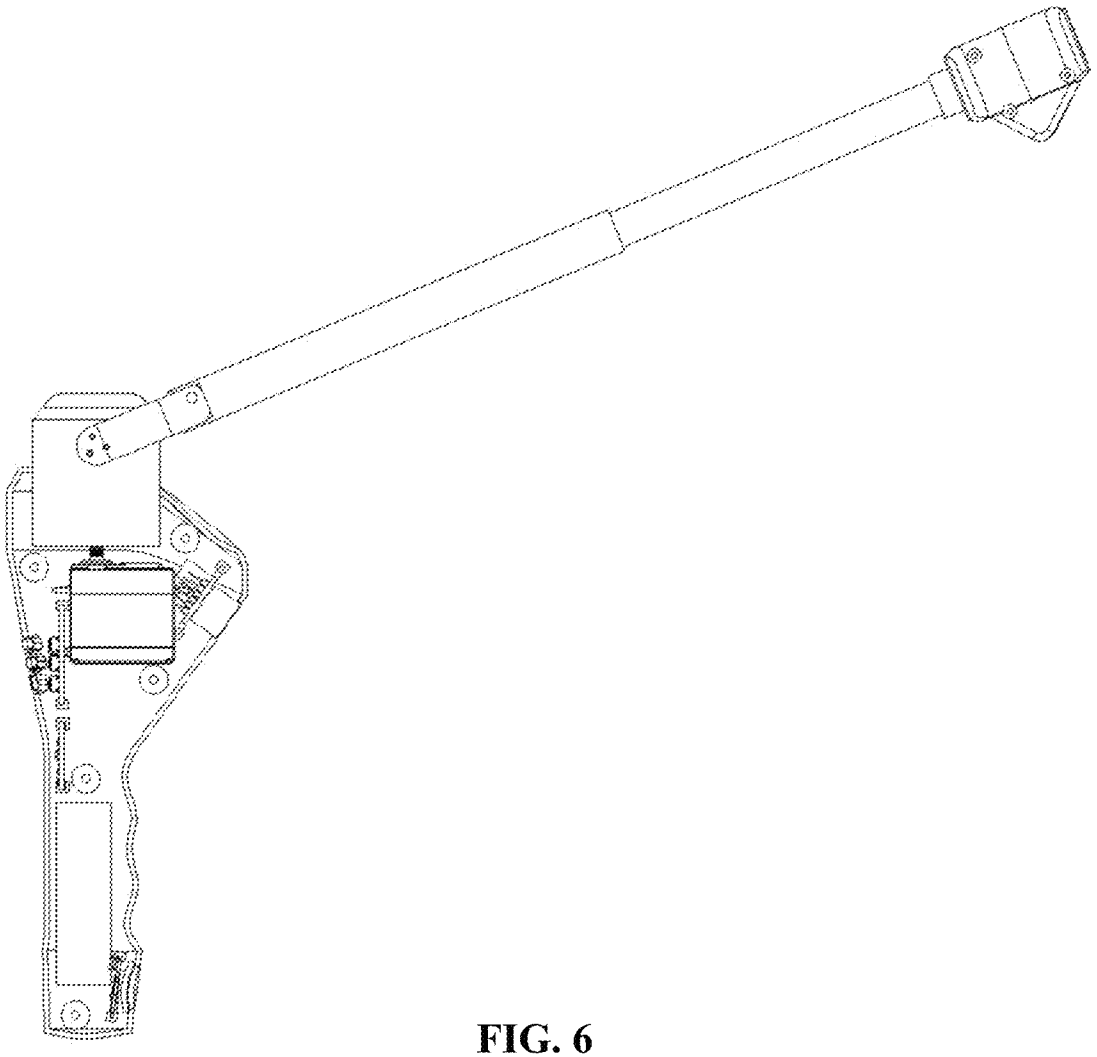
Figure 7:
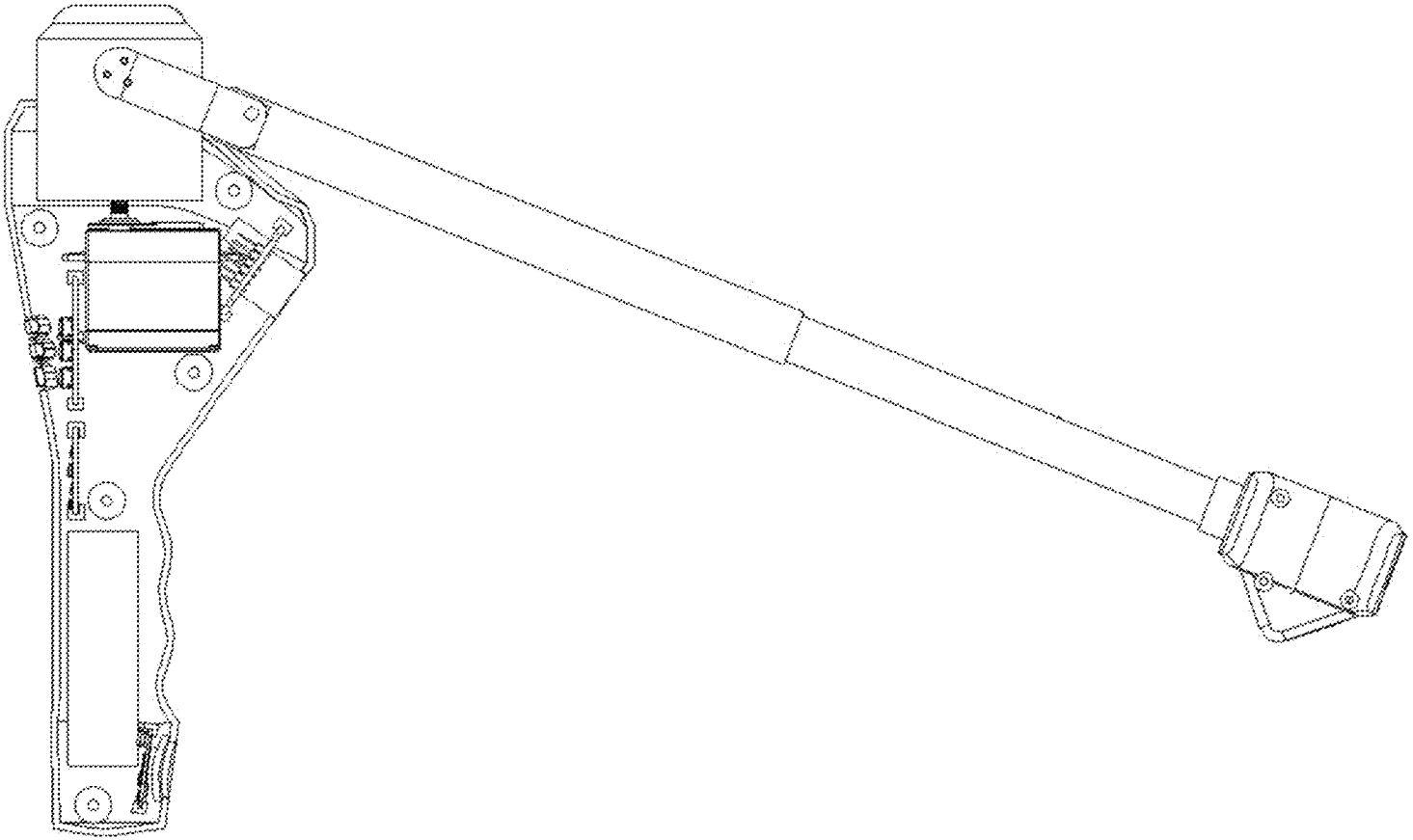
Figure 8:
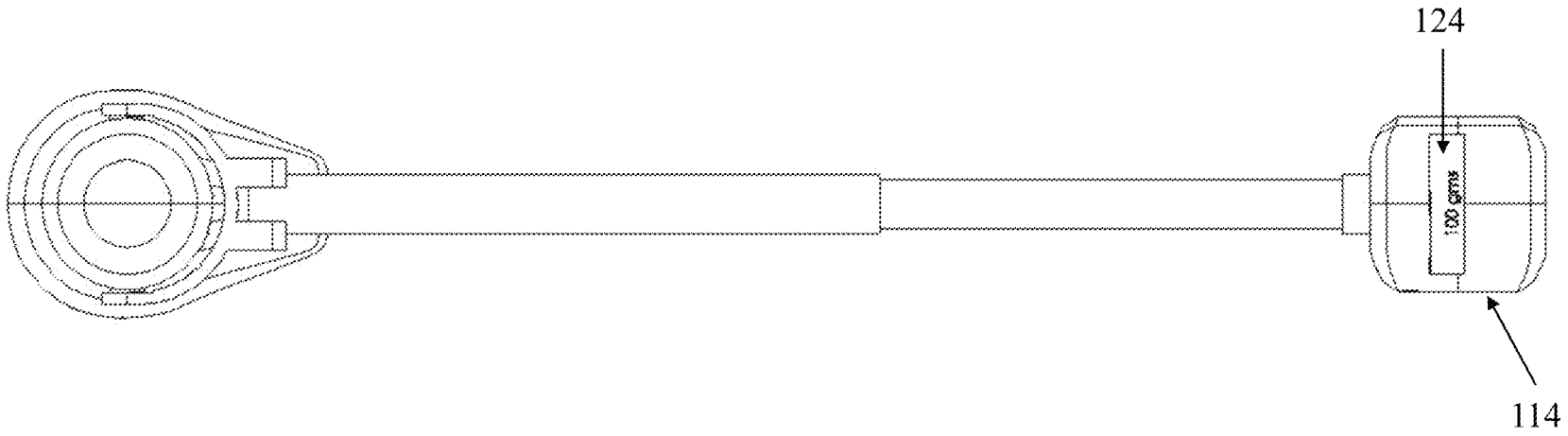
FIGS. 8-9 are elevational top views of an exemplary handheld electro-mechanical walking stick, in accordance with the present invention.
Figure 9:
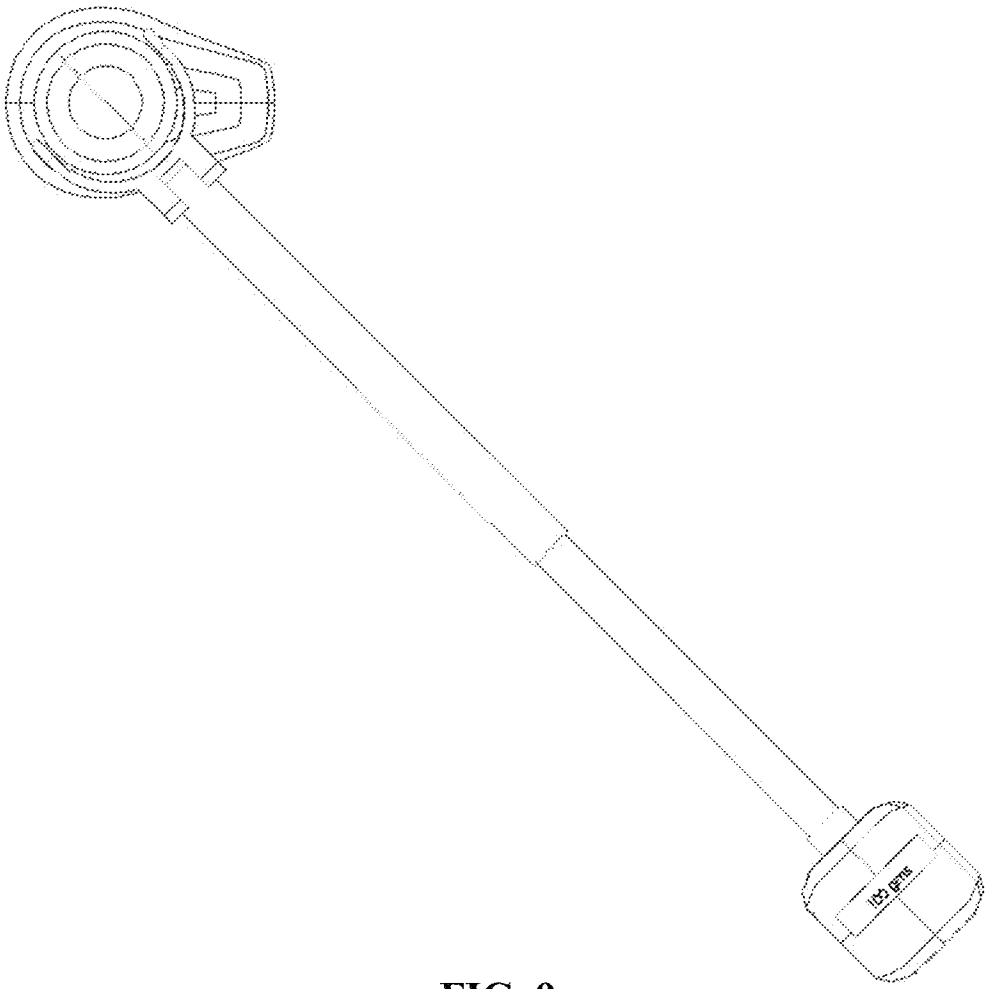
Figure 10:
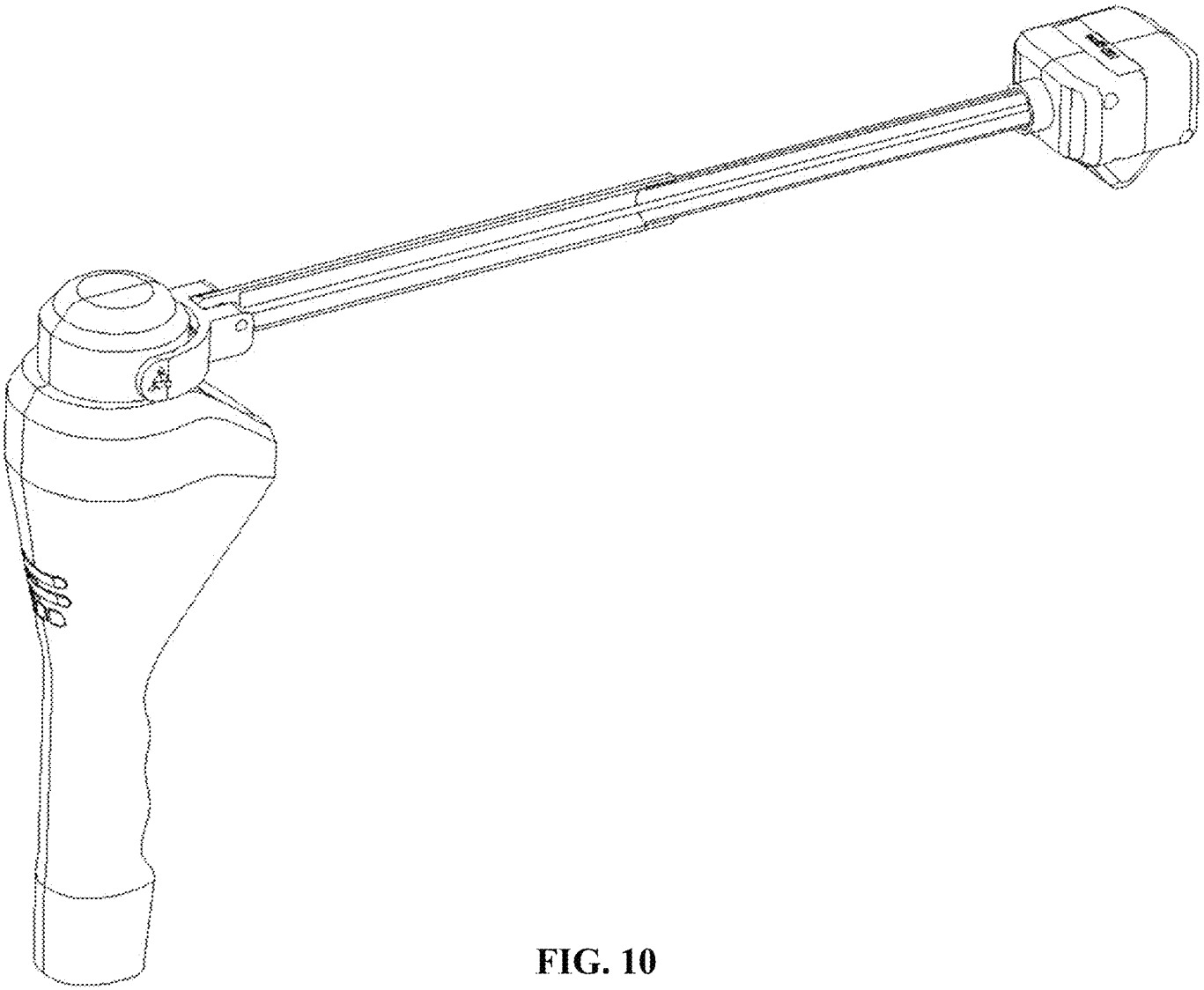
FIG. 10 is a perspective side view of an exemplary handheld electro-mechanical walking stick, in accordance with the present invention.

The device 100 also includes an electronic controller 210 electrically coupled to the battery power source 200 and communicatively coupled (wherein "communicatively coupled" is represented with arrows in the flowchart diagram depicted in FIG. 4) to the at least one electronic motor 204 and the at least one of a distance sensor 216 and a camera 112, the electronic controller 210 operably configured to receive detection of the objects spatially displaced from the second free end 110 and cause selective rotation of the cantilevered guide arm member 108 in a direction away from the detected objects to generate a deviation angle θ (as seen in FIG. 1) with respect to the operation position along the arm translation path, thereby causing an impetus to the user holding the handle member 102 through a torque generated by the arm weight 124 and guiding the user where to walk. Said differently, the electronic controller 210 is operably configured to receive and detect digital representations of objects ambient to the second free end 110 of the cantilevered guide arm member 108. To that end, the electronic controller 210 may include resident software programs or instructions operably configured to receive and detect (i.e., decipher) digital representations within an ambient environment. To that end, other known devices have used similar object-detection software, such as Ellis, U.S. Pat. No. 5,973,618 and Ratner et al., U.S. Pat. No. 8,467,674, wherein said references are incorporated herein by reference.

Unlike known devices, however, the electronic controller 210 is operably configured to cause selective rotation (e.g., by sending wired or wireless signals to the motor(s) to operate) of the cantilevered guide arm member 108 with respect to the handle member 102. By virtue of the concentrated weight of the arm weight 124, the second free end 110 of the cantilevered guide arm member 108 is weighted or has an increased weight (e.g., 0.25 lb-1 lb) relative to the remainder of the cantilevered guide arm member 108, thereby causing or generating an impetus, i.e., a force that manifests in a readily perceptible or detectable tactile sensation, experienced by the user holding the handle member 102, of the cantilevered guide arm member 108 in a direction away from an object detected by the camera 112 and software of the electronic controller 210, and ambient to the second free end 110, i.e., immediately surrounding the second free end 110, thereby guiding the user where to walk. In one embodiment, for example, if an object, of a width of approximately 2 feet, is detected within 3 feet in front of the user, and there are no obstructions to the left or right of the object, the motor will cause the second free end 110 to rotate (at approximately 5-40 rpm), thereby causing a torque of approximately 1.75 lbf in 10 lbf in experienced by the user. In one embodiment, the weight of the second free end 110 is specially or additionally created by the weight of the camera 112, an object of a high density, and/or the battery power source 200.

In one embodiment, the second free end 110 of the cantilevered guide arm member 108 automatically returns to the operation or "home" position upon passing a detected objection. The operation position may be, in one embodiment, a substantially perpendicular configuration and orientation of the cantilevered guide arm member 108 with respect to the front handle surface 120 of the handle member 102. Said differently, the operation position includes the cantilevered guide arm member 108 disposed at a perpendicular angle (90°) with respect to the front handle surface 120. In other embodiments, the second free end 110 of the cantilevered guide arm member 108 requires user invention (e.g., by depressing a return button that is programmed to return the cantilevered guide arm member 108 to its operation position) to place the second free end 110 and/or the cantilevered guide arm member 108 in the operation position. The device 100, namely the second free end 110 of the cantilevered guide arm member 108, may also include a sensor operably configured to detect movement in the ambient environment of the device that is utilized in the programming to cause movement of the second free end 110 and/or cantilevered guide arm member 108 (to its operation position or a guiding position).

As best depicted in FIG. 1, the device 100 may further comprise an arm head housing 114 disposed along the arm length and with the arm weight 124 and the at least one of a distance sensor 216 and a camera 112 housed therein. Beneficially, the arm head housing 114 structurally protects the arm weight 124 and the at least one of a distance sensor 216 and a camera 112 housed therein from damage, e.g., that caused by rain, wind, snow, etc. particularly as the device 100 is designed and configured to be used outdoors (as well as indoors). In a preferred embodiment, the arm head housing 114 defines, or is disposed on, the second free end 110 of the cantilevered guide arm member 108 to beneficially detect movement a greater distance ahead of the user's location and provide the user with a greater amount of time to shift their trajectory and avoid coming into direct physical contact with the detected objects. In an alternate embodiment, the arm weight 124 may be selectively and removably disposed on the external surface of the arm head housing 114, rather than within the arm head housing 114, allowing the user to add (or remove) arm weights 124 as needed to improve the tactile sensation or impetus that is readily detected or perceived when an object is detected. Perspective views of a preferred embodiment of the device 100 are further depicted in FIGS. 2-10.

The device 100 may also include a gyroscope 1102 housed within the handle member 102, communicatively coupled to the electronic controller 210, and operably configured to detect a cardinal direction orientation (i.e., north, south, east, west) of the front handle surface 120, the electronic controller 210 operably configured to cause selective rotation of the cantilevered guide arm member 108 to the operation position aligned, partially or completely, with the cardinal direction orientation of the front handle surface 120 after detecting the deviation angle θ. The gyroscope 1102 is a conventional gyroscope device or instrument that measures or maintains rotational motion. In some embodiments, the gyroscope 1102 may be or include a microelectromechanical system (MEMS) gyro which measures angular velocity. The gyroscope 1102 may be a single, double, or triple axis gyro to measure rotation around any of the following axes: x, y, and z.

In one embodiment, the device may include a memory storage unit 1100 housed on the device 100 and storing a plurality of digital geographic locations each having a plurality of GPS boundary coordinates; and at least one button 220*a-n* operably configured to electronically access the plurality of GPS boundary coordinates for the plurality of digital geographic locations. In other words, the device includes a resident memory configured to store GPS coordinates or locations of the user and a history of detected objects located in said GPS coordinates or locations, wherein said history and location may be selectively and readily recalled by the user (e.g., by using at least one button or voice activation). This feature beneficially allows a user to readily access, recall, and select GPS coordinates or locations that have been previously frequented by the user, e.g., a user's home, office, etc. In an alternate embodiment, the device 100 may also be operably configured to digitally map all detected objects in any given GPS coordinates or location and store, on the memory storage unit 1100, the digital map compiled and associated with each individual, specific, or designated GPS coordinates or location. The device 100 may have the functional capability of (selectively or continuously) automatically detecting its own then-current GPS coordinates or location and recalling the digital map associated with those specific GPS coordinates or location, if one exists (i.e., if the location is one that was previously mapped by the device 100). In turn, the device 100 would guide the user based on the previously sketched digital map while continuously accounting for, and alerting the user of, any new or previously undetected objects or obstacles. This feature may beneficially improve accuracy, preserve battery power, and reduce the time needed for the device 100 to detect any objects. The device 100 may work individually with GPS or work together with GPS to provide multiple ways in which the device can locate and track geographic locations in which the user is located. As such, the electronic controller 210 may be operably configured to cause selective rotation of the cantilevered guide arm member 108 to a desired deviation angle θ corresponding to one of the plurality of digital geographic locations and a cardinal direction orientation of the front handle surface 120. As seen in FIG. 2, the device 100 may also comprise a printed circuit board (PCB) 222.

Figure 12:
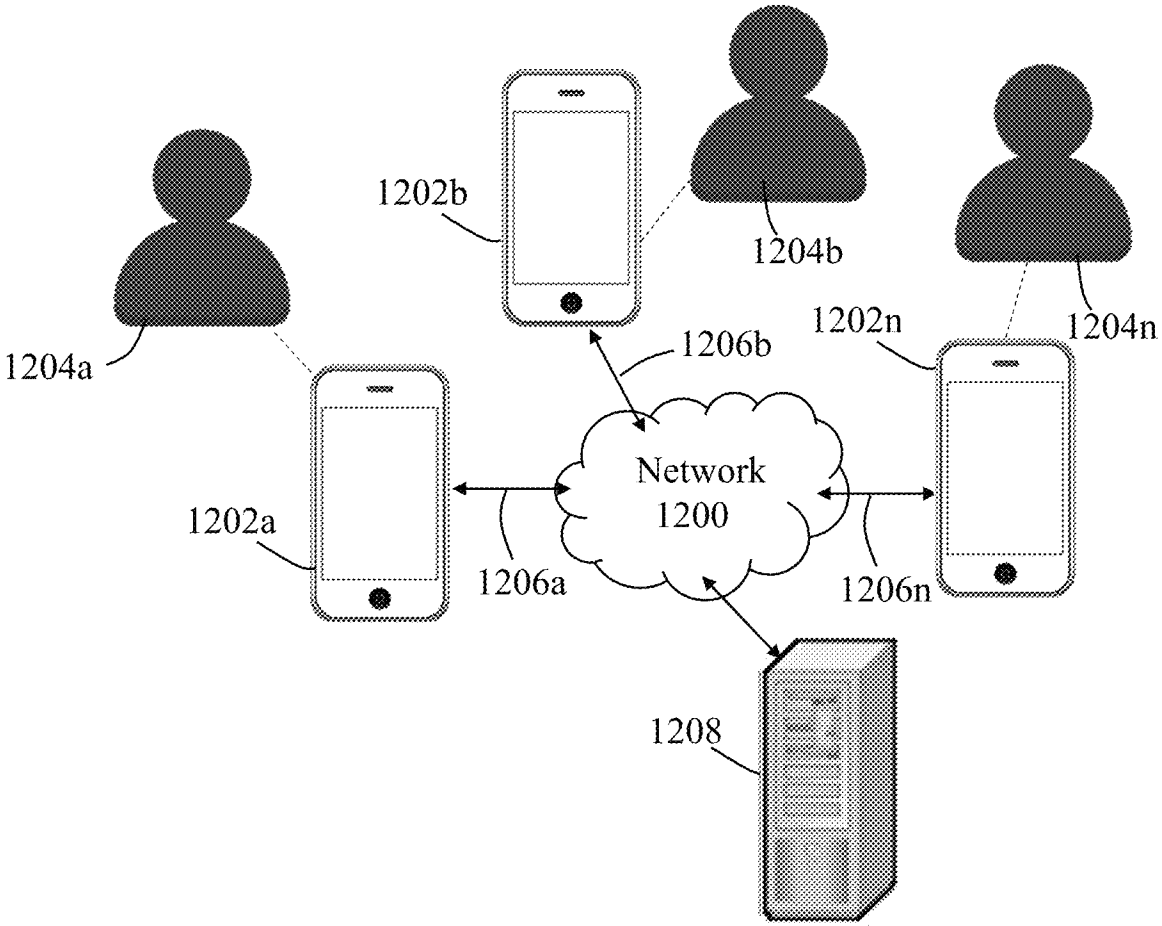
FIG. 12 is an exemplary network implementing wireless communication of a handheld electro-mechanical walking stick, in accordance with the present invention.
Figure 13:
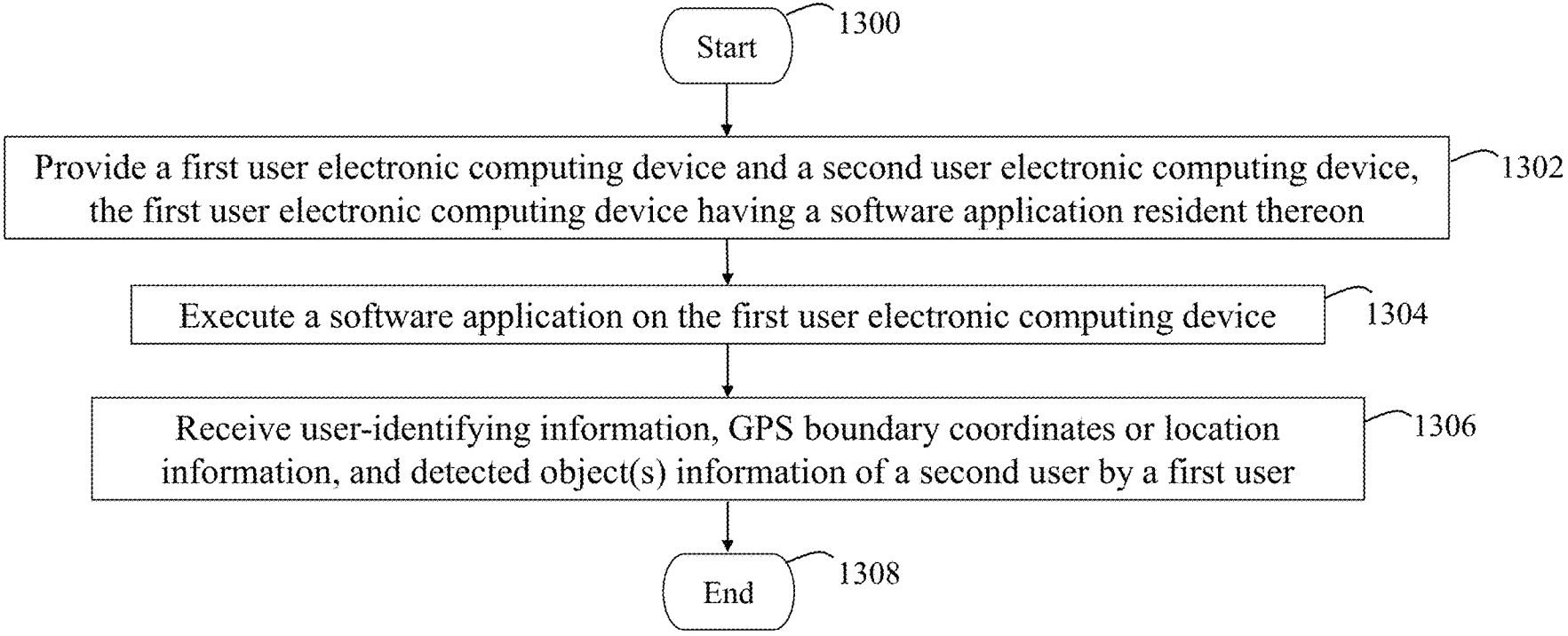
FIG. 13 is a process flow diagram depicting wireless communication of a handheld electro-mechanical walking stick, in accordance with the present invention.

The cantilevered guide arm member 108 may be operably configured to rotate in an upward orientation when the cantilevered guide arm member 108 is within 50 meters of a preselected digital geographic location to timely and accurately alert a user of the distance remaining between the user and the preselected digital geographic location, i.e., GPS coordinates or locations, so the user may adjust the speed of their gait accordingly. As best seen in FIGS. 11-13, the plurality of digital geographic locations may be communicatively coupled to the electronic controller 210 over a network 1200 to communicate an electronic notification of the plurality of digital geographic locations and/or all detected objects to a remote electronic communication device 1202*a-n*. Said differently, the electronic controller 210 may communicate over a network 1200 using a short-range communication protocol, for example, a Bluetooth communication protocol, which may also operate as a receiver, transmitter, and/or transceiver. The PAN interface may permit the electronic controller 210 to connect wirelessly to another electronic computing device, e.g., software application, via a peer-to-peer connection or other communicatively coupled configuration. The network interface(s) may also include a local area network (LAN) interface. The LAN interface may be, for example, an interface to a wireless LAN, such as a Wi-Fi network. In one embodiment, there is a wireless LAN that provides the electronic controller 210 with access to the Internet for receiving and sending inputs/messages to, for example, an administrator server 1208 or other electronic device over, for example, the Internet. The range of the LAN interface may generally exceed the range available via the PAN interface. Typically, a connection between two electronic devices 1202*a-b* via the LAN interface may involve communication through a network router or other intermediary device. Exemplary connections between devices 1202*a-n* over the network 1200 are depicted in FIG. 12 with arrows 1206*a-n*. In one embodiment, the electronic controller 210 and an electrical computing device, e.g., mobile phone, may be paired, or establishing a communication linkage, before, during, or after the user intends to use the device 100. The pairing may be through an RFID means.

Additionally, the network interface(s) may include the capability to connect to a wide area network (WAN) via WAN interface. The WAN interface may permit a connection to a cellular mobile communications network. The WAN interface may include communications circuitry, such as an antenna coupled to a radio circuit having a transceiver for transmitting and receiving radio signals via the antenna. The radio circuit may be configured to operate in a mobile communications network, including but not limited to global systems for mobile communications (GSM), code division multiple access (CDMA), wideband CDMA (WCDMA), and the like.

Figure 15:
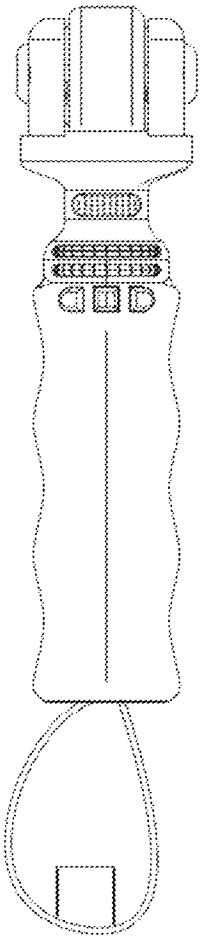
FIG. 15 is an elevational rear view of a handheld electro-mechanical walking stick, in accordance with an alternate embodiment of the present invention.
Figure 14:
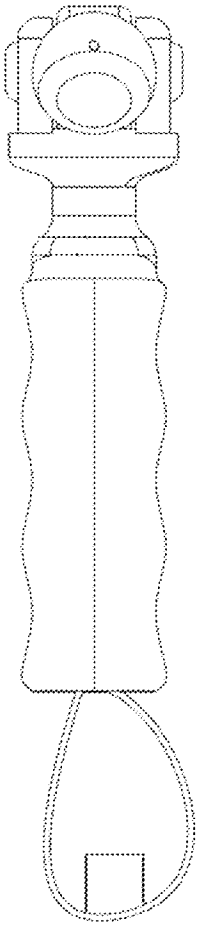
FIG. 14 is an elevational front view of a handheld electro-mechanical walking stick, in accordance with an alternate embodiment of the present invention.
Figure 16:
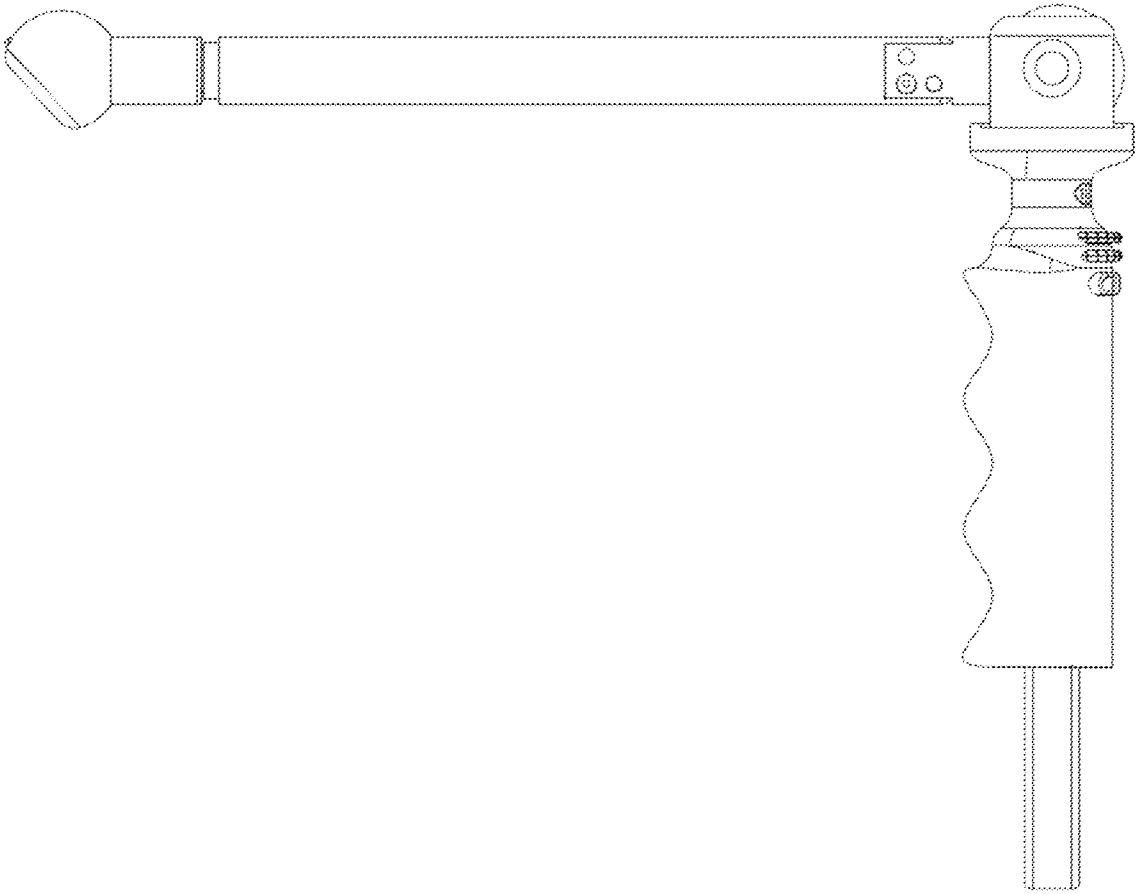
FIGS. 16-17 depict elevational side views of a handheld electro-mechanical walking stick, in accordance with an alternate embodiment of the present invention.
Figure 17:
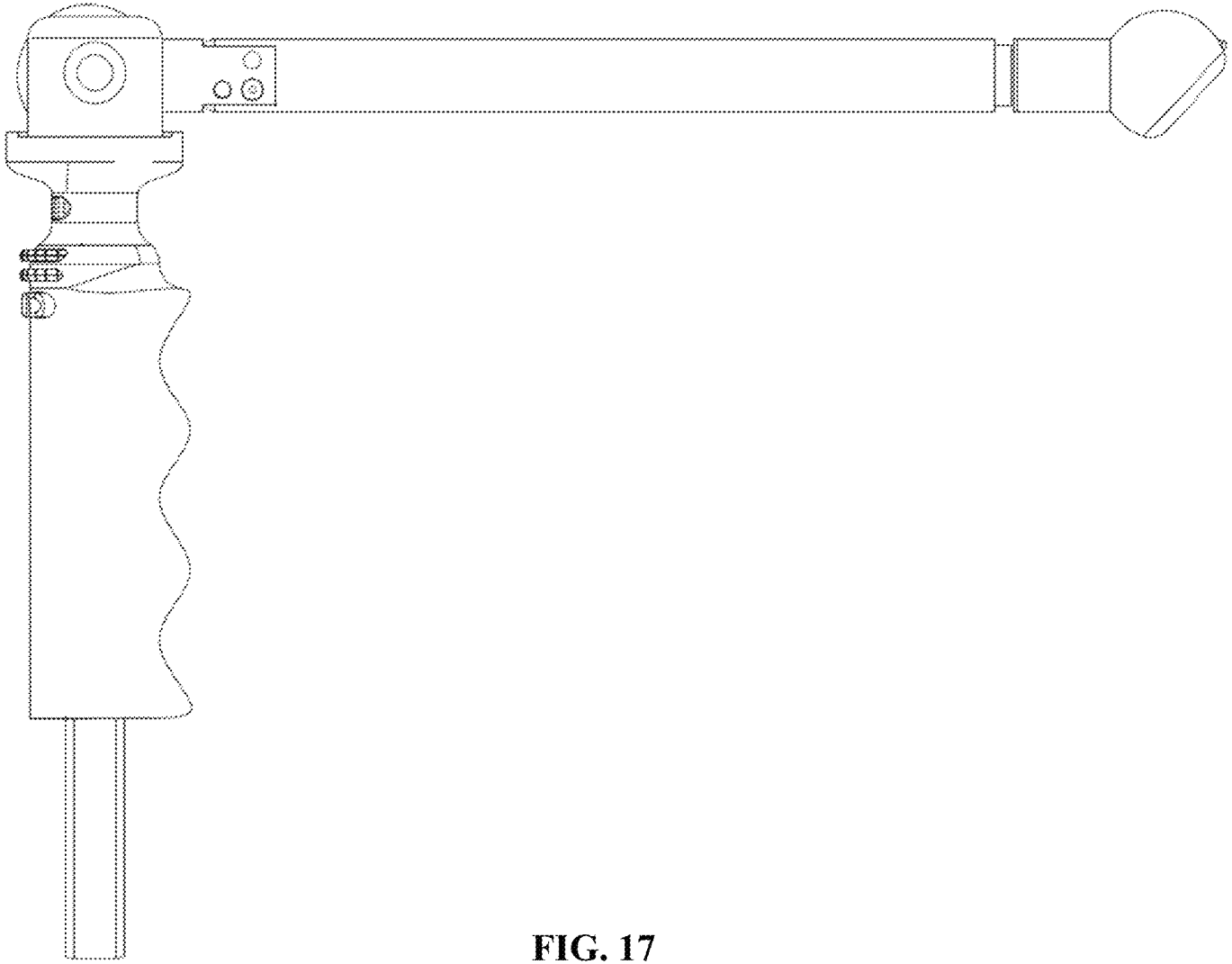
Figure 18:
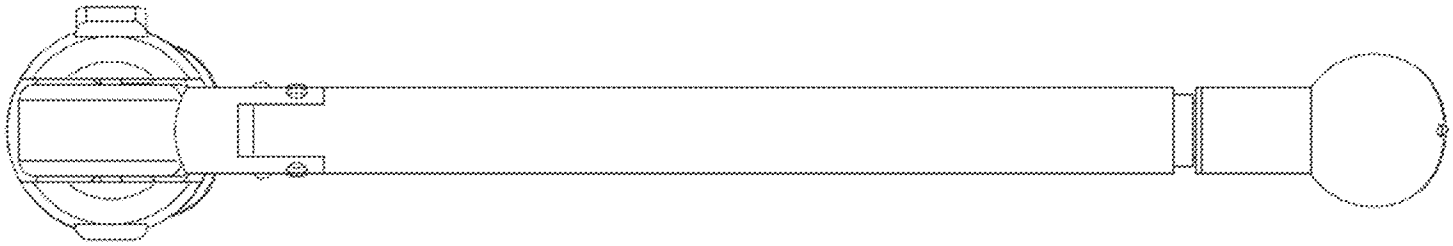
FIG. 18 is an elevational top view of a handheld electro-mechanical walking stick, in accordance with an alternate embodiment of the present invention.
Figure 19:
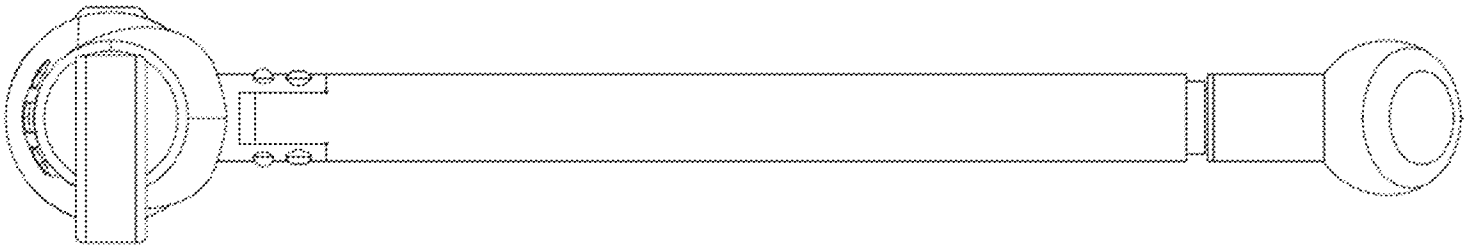
FIG. 19 is an elevational bottom view of a handheld electro-mechanical walking stick, in accordance with an alternate embodiment of the present invention.
Figure 20:
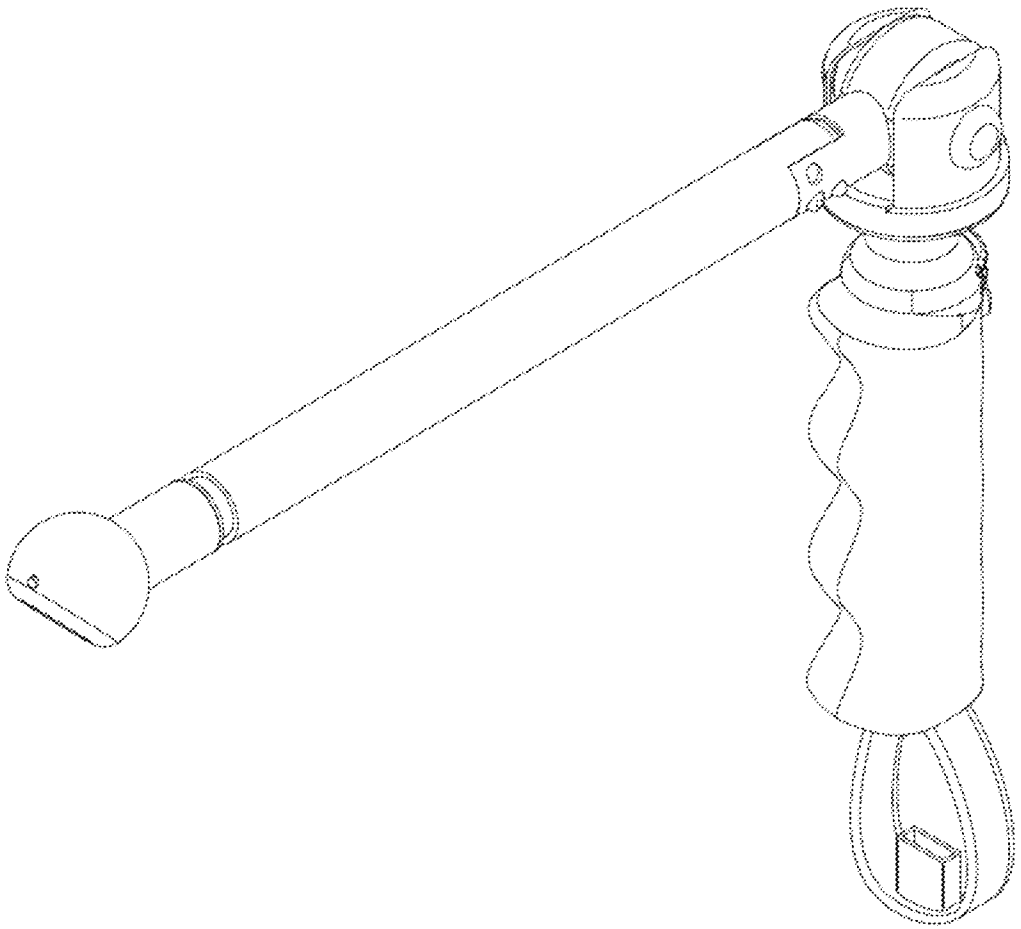
FIGS. 20-21 depict perspective side views of a handheld electro-mechanical walking stick, in accordance with an alternate embodiment of the present invention.
Figure 21:
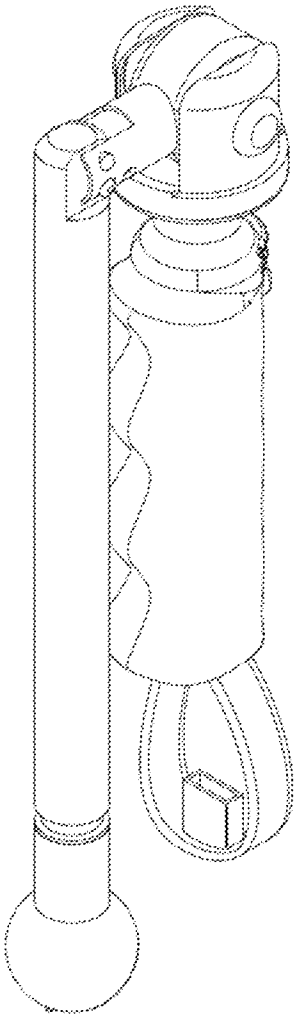

As best seen in the flowchart diagram of FIG. 13, the communication may comprise an initial step of providing a first user electronic computing device and a second user electronic computing device, the first user electronic computing device having a software application resident thereon and a second step of executing a software application on the first user electronic computing device. After the device 100 collects information regarding the user, the GPS boundary coordinates or location, and/or any objects or obstacles detected, the method includes a next step of receiving the user-identifying information, GPS boundary coordinates or location information, and detected object(s) information of the device 100, i.e., of the second user, by the first user. In this way, the method beneficially allows third parties, e.g., the user's family or friends, to receive alerts and readily ascertain the user's geolocation including, without limitation, whether the user is prevented from entering/exiting a specific location, e.g., the user's home, by an obstacle or object. Further methodology includes the first user receiving the detected object(s) information being stored locally on the device 100 or otherwise received by the device after the user selects the location on the device (e.g., using one of the buttons 220*a-n*, wherein numeral 220 designates the button interface or switch/circuit receiving contact with the one or more buttons 220*a-n*). For example, depression of button 220*a* may enable the user to select the category of the location, e.g., bus stop, train station, hospital, or pre-recorded and/or stored routes taken by the user or others. Each of the location categories may then be announced to the user via a speaker and the selection received through a microphone. Alternatively, the other button 220*n* will enable the user to select the specific location from the category desired by the user. Then, the device will receive the desired GPS coordinates and directions and, along with the user's or device's current location/GPS position, will guide the user to reach his or her desired and selected location using. As seen in FIG. 15, in a preferred embodiment, there are 4 buttons 220*a-d*, e.g., a GPS, up, down, and enter button, all of which may be used when the speaker/microphone configuration is not practical or feasible, e.g., in public places or outdoors where external noises may make it difficult for a user to hear the prompts from the speaker.

In one embodiment, the at least one of a distance sensor and a camera 112 are each operably configured to detect objects spatially displaced six feet or less from the second free end 110 therefrom. This feature beneficially alerts a user of objects or obstacles in the ambient environment, i.e., in the user's immediate surroundings, so the user has sufficient time and opportunity to avoid the detected objects or obstacles.

Figure 3:
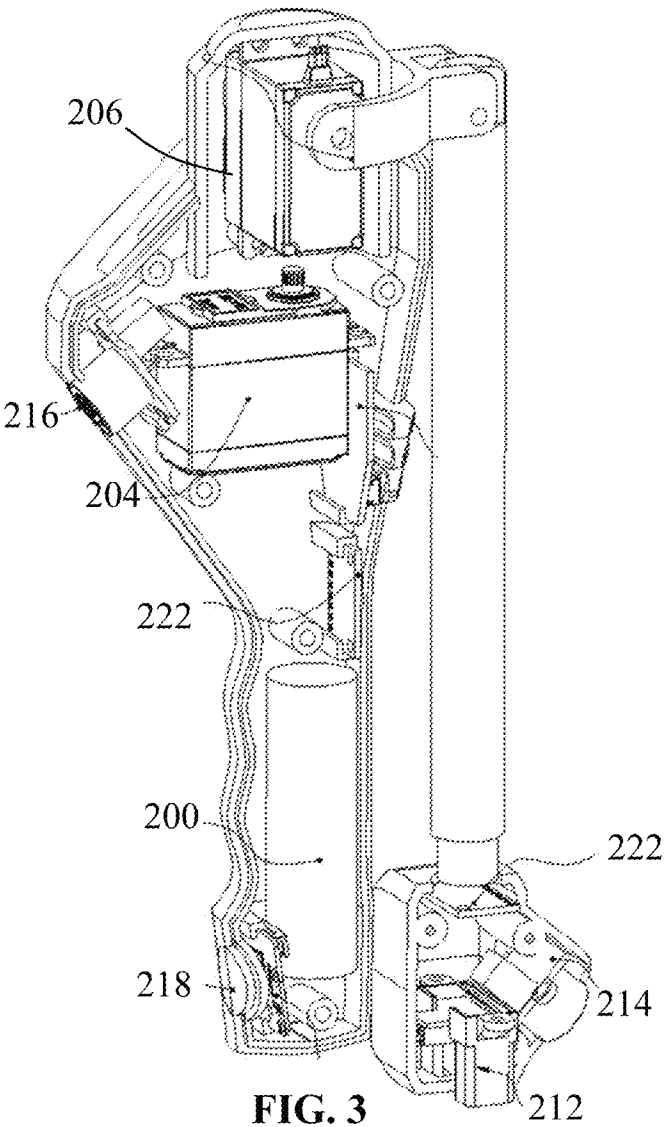
FIG. 3 is another cross-sectional side view of the exemplary handheld electro-mechanical walking stick of FIG. 1, in accordance with the present invention.

In accordance with one embodiment, the cantilevered guide arm member 108 must be oriented in the operation position to selectively rotate or translate along the arm translation path. The operation position includes the cantilevered guide arm member 108 disposed at a perpendicular angle (90°) with respect to the front handle surface 120. Said differently, the cantilevered guide arm member 108 may be selectively configured into a compact position, as best depicted in FIG. 3, to facilitate ease of storage and transportation. For the cantilevered guide arm member 108 to selectively rotate or translate along the arm translation path, the cantilevered guide arm member 108 must be oriented in the operation position.

The cantilevered guide arm member 108 may also include a plurality of arm members 116*a-n*, wherein "n" is any number greater than one, telescopically coupled to one another and operably configured to selectively adjust the arm length. This may advantageously provide the user with a greater "moment" or "torque" on the user's wrist or forearm because the length is being increased, wherein "torque" is defined as a twist to an object around a specific axis, i.e., a force applied perpendicularly to a lever multiplied by its distance from the lever's fulcrum (the length of the lever arm) is its torque. In the context of the present invention, the torque would be greater in the case of a longer cantilevered guide arm member 108 and lesser in the case of a shorter cantilevered guide arm member 108. As such, a user may selectively vary the length of the cantilevered guide arm member 108 to adjust the torque that is generated when an object is detected. To the user, this would be manifested in the form of a tactile sensation that is readily perceptible or detectible and that the user can physically feel through the user's grip on the handle member 102. The arm members 116*a-n* may be lockable in a particular length to provide a stable length of the device 100 unless and until the length is adjusted by a user. The length of the device 100, i.e., the combined length of the handle member 102 and the cantilevered guide arm member 108, is approximately between 40 cm to 60 cm though this may substantially increase when the plurality of arm members 116*a-n* are selectively adjusted.

The electronic motor assembly 202 may further comprise a pan motor 204 operably configured to pan the camera 112 horizontally from a fixed position; and a tilt motor 206 operably configured to tilt the camera 112 vertically from a fixed position. In a preferred embodiment, both a pan motor 204 and a tilt motor 206 are included in the electronic motor assembly 202, wherein the pan motor 204 is operably configured to rotate the camera 112 up to 355° horizontally (i.e., left and right) and the tilt motor 206 is operably configured to tilt the camera 112 up to 60° up and 60° down vertically (i.e., up and down). The wide-angle detection in both a vertical and horizontal orientation increases the ambient area that is scanned for possible detection of objects or obstacles. Said differently, the device 100 is beneficially able to detect obstacles directly in front of, to the side of, above, and potentially behind the user when both a pan motor 204 and a tilt motor 206 are used. FIGS. 14-21 depict several perspective and elevational views of an alternate embodiment of the present invention.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above-described features.

Although a specific order of executing the process steps has been described herein and depicted in the figures, the order of executing the steps may be changed relative to the order shown in certain embodiments. Also, two or more steps described or shown as occurring in succession may be executed concurrently or with partial concurrence in some embodiments. Certain steps may also be omitted for the sake of brevity. In some embodiments, some or all of the process steps can be combined into a single process.

What is claimed is:

1. A handheld electro-mechanical walking aid comprising:

a handle member for grasping by a user and having a first end, a second end, a handle member length separating the first and second ends of the handle member, a front handle surface, and a rear handle surface opposing the front handle surface;

an electronic motor assembly with at least one electronic motor electrically coupled to a battery power source;

a cantilevered guide arm member operably coupled to the at least one electronic motor, with a first end rotatably coupled to the handle member, a second free end opposing the first end of the cantilevered guide arm member, an arm length separating the first end and second free end of the cantilevered guide arm member, an arm weight disposed proximal to the second free end and of a concentrated weight of at least approximately 0.2lbs, and operably configured to translate along an arm translation path and have an operation position along the arm translation path with a longitudinal axis of the cantilevered guide arm member disposed at a substantially perpendicular angle with respect to the front handle surface and aligned with the front handle surface;

at least one of a distance sensor and a camera each having an operation surface operably configured to face in alignment configuration with the longitudinal axis of the cantilevered guide arm member when in the operation position and operably configured to detect objects spatially displaced from the second free end therefrom; and an electronic controller electrically coupled to the battery power source and communicatively coupled to the at least one electronic motor and the at least one of a distance sensor and a camera, the electronic controller operably configured to receive detection of the objects spatially displaced from the second free end and cause selective rotation of the cantilevered guide arm member in a direction away from the detected objects to generate a deviation angle 0 with respect to the operation position along the arm translation path, thereby causing an impetus to the user holding the handle member through a torque generated by the arm weight and guiding the user where to walk.

2. The handheld electro-mechanical walking aid according to claim 1, wherein:

the operation position includes the cantilevered guide arm member disposed at a perpendicular angle with respect to the front handle surface.

3. The handheld electro-mechanical walking aid according to claim 1, further comprising:

an arm head housing disposed along the arm length and with the arm weight and the at least one of a distance sensor and a camera housed therein.

4. The handheld electro-mechanical walking aid according to claim 3, wherein:

the head housing defines the second free end of the cantilevered guide arm member.

5. The handheld electro-mechanical walking aid according to claim 3, wherein the arm head housing further comprises:

a laser-guided distance sensor and a ultrasound distance sensor communicatively coupled to the electronic controller and operably configured to detect objects spatially displaced from the second free end therefrom.

6. The handheld electro-mechanical walking aid according to claim 1, further comprising:

a gyroscope housed within the handle member, communicatively coupled to the electronic controller, and operably configured to detect a cardinal direction orientation of the front handle surface, the electronic controller operably configured to cause selective rotation of the cantilevered guide arm member to the operation position aligned with the cardinal direction orientation of the front handle surface after detecting the deviation angle θ.

7. The handheld electro-mechanical walking aid according to claim 6, further comprising:

a memory storage unit housed on the handheld electro-mechanical walking aid and storing a plurality of digital geographic locations each having a plurality of GPS boundary coordinates; and at least one button operably configured to electronically access the plurality of GPS boundary coordinates for the plurality of digital geographic locations.

8. The handheld electro-mechanical walking aid according to claim 6, wherein:

the electronic controller is operably configured to cause selective rotation of the cantilevered guide arm member to a desired deviation angle θ corresponding to one of the plurality of digital geographic locations and a cardinal direction orientation of the front handle surface.

9. The handheld electro-mechanical walking aid according to claim 6, wherein:

the cantilevered guide arm member is operably configured to rotate in an upward orientation when the cantilevered guide arm member is within 50 meters of a preselected digital geographic location.

10. The handheld electro-mechanical walking aid according to claim 6, wherein:

the plurality of digital geographic locations are communicatively coupled to the electronic controller over a network.

11. The handheld electro-mechanical walking aid according to claim 1, wherein:

the at least one of a distance sensor and a camera are each operably configured to detect objects spatially displaced six feet or less from the second free end therefrom.

12. The handheld electro-mechanical walking aid according to claim 1, wherein:

the cantilevered guide arm member must be oriented in the operation position to selectively rotate or translate along the arm translation path.

13. The handheld electro-mechanical walking aid according to claim 1, wherein the electronic motor assembly further comprises:

a pan motor operably configured to pan the camera horizontally from a fixed position; and a tilt motor operably configured to tilt the camera vertically from a fixed position.

14. The handheld electro-mechanical walking aid according to claim 1, wherein the cantilevered guide arm member further comprises:

a plurality of arm members telescopically coupled to one another and operably configured to selectively adjust the arm length.

* * * * *